US007096615B2

(12) United States Patent
Gardi

(10) Patent No.: US 7,096,615 B2
(45) Date of Patent: Aug. 29, 2006

(54) CONTAINER FOR SMALL SIZED OBJECTS SUCH AS CANDIES, CHOCOLATES, COSMETICS, FRAGRANCES AND SMALL GIFTS

(75) Inventor: Chanan Gardi, Florence (IT)

(73) Assignee: Editoriale Friulana S.R.L., (IT)

( * ) Notice: Subject to any disclaimer, the term of this patent is extended or adjusted under 35 U.S.C. 154(b) by 0 days.

(21) Appl. No.: 11/188,342

(22) Filed: Jul. 25, 2005

(65) Prior Publication Data

US 2005/0252813 A1 Nov. 17, 2005

Related U.S. Application Data

(63) Continuation of application No. 10/390,409, filed on Mar. 17, 2003, now abandoned.

(51) Int. Cl.
*G09F 1/00* (2006.01)

(52) U.S. Cl. ..... 40/124.06; 40/124.191; 40/124.11; 206/462; 206/463; 206/466; 206/472

(58) Field of Classification Search ..... 40/124.191, 40/124.06, 124.11, 124.01; 281/38; 283/63.1; 434/81; 446/147; 206/462, 463, 466, 472, 206/489

See application file for complete search history.

(56) References Cited

U.S. PATENT DOCUMENTS

| | | | | |
|---|---|---|---|---|
| 1,440,487 | A * | 1/1923 | Newell | 446/339 |
| 2,491,424 | A * | 12/1949 | Stalter | 53/141 |
| 3,298,515 | A * | 1/1967 | Watts, Jr. | 206/469 |
| 3,497,059 | A * | 2/1970 | Watts, Jr. | 206/463 |
| 6,050,420 | A * | 4/2000 | Green | 206/764 |

* cited by examiner

*Primary Examiner*—Gary C. Hoge
(74) *Attorney, Agent, or Firm*—McGlew and Tuttle, PC

(57) ABSTRACT

A container for small sized objects such as candies, chocolates, cosmetics, fragrances and small gifts which comprises: a first element (1) having a first and a second apertures (2) symmetrically disposed with respect to a hinge axis (140) and whose outline defines a geometric or fancy figure; a flap or patch of fabric or cloth (3) applied on the rear surface (10) of said first element (1); a second element (4) associated with the rear surface of said first element (1) on the back of said fabric (3) so that the said fabric will result interposed between the first (1) and second (4) elements, the same fabric being able to partly project from the surface defined by said first element (1) or said second element (4), the surface of the latter being provided, likewise the surface of the first element (1), with a third and a fourth apertures (40), disposed in correspondence to said first and second apertures (2), as to coincide with each other when the container (S) is in closed condition, that is, folded over about said axis (140).

8 Claims, 2 Drawing Sheets

S
80
8
140
2
1
8

4
14
40
140
7

1
3
2
S
1
3
1
3

CONTAINER FOR SMALL SIZED OBJECTS SUCH AS CANDIES, CHOCOLATES, COSMETICS, FRAGRANCES AND SMALL GIFTS

This is a Continuation of application Ser. No. 10/390,409 filed Mar. 17, 2003, now abandoned and the entire disclosure of this prior application is considered to be part of the disclosure of the accompanying application and is hereby incorporated by reference therein.

SPECIFICATION

The present invention refers to a container for small sized objects such as candies, chocolates, cosmetics, fragrances and small gifts. The present invention is utilizable also as a greeting card.

BACKGROUND OF THE INVENTION

Small sized objects as candies, chocolates, cosmetics, fragrances and small gifts are usually contained in boxes, envelopes or bags.

SUMMARY OF INVENTION

The present invention has many purposes and provides many advantages.

It provides a container for small objects which can be easily filled and refilled (i.e. re-utilized). This invention provides a container which can be designed and produced with a very wide range of choices with regard its color, paper, texture as well as choices with regard to the visibility of the item contained within. The container can be easily stored and displayed. It will also change its appearance according to the size, shape, color and quantity of object(s) contained within.

These results have been achieved in the present invention by adopting the idea of making a container having the characteristics indicated in the claim 1. Further characteristics being set forth in the dependent claims.

BRIEF DESCRIPTION OF THE DRAWINGS

In the description that follows, reference will be made to the attached drawings which are to be considered by way of non limiting example, wherein:

FIG. 1 is a side view of the container in closed configuration;

FIG. 2 is a schematic, antero-lateral perspective view of the container of FIG. 1, in closed configuration;

FIG. 3 is a schematic, antero-lateral perspective view of the container of FIG. 1, in open configuration, shown with candies which can be contained;

FIG. 4 is a schematic exploded perspective view of a container-display stand in which more containers of the type shown in FIGS. 1–3 can be disposed;

DETAILED DESCRIPTION OF THE INVENTION

Figures 1, 2, 3, 4:
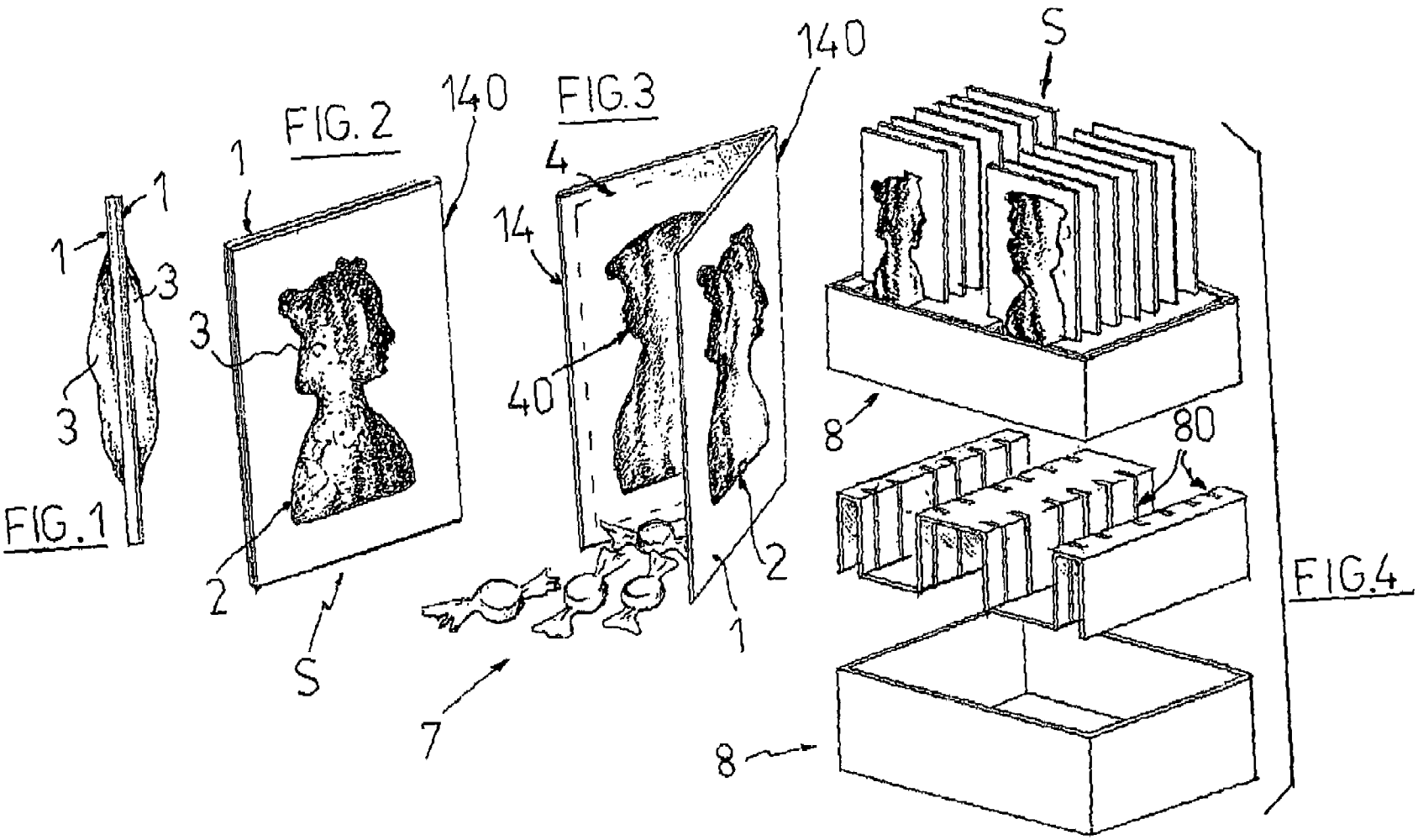
FIGS. 1–4 show schematically a possible embodiment and use of a structure according to the invention.

With reference to the examples shown in the attached drawings, a container according to the invention comprises:

- a first element 1 having a first and a second apertures 2 symmetrically disposed with respect to a hinge axis 140 and whose outline defines a geometric or fancy figure;
- a flap or patch of fabric or cloth 3 applied on the rear surface 10 of said first element 1;
- a second element 4 associated with the rear surface of said first element 1 on the back of said fabric 3 so that the said fabric will result interposed between the first 1 and second 4 elements, the same fabric being able to partly project from the surface defined by said first element 1 or said second element 4, the surface of the latter being provided, likewise the surface of the first element 1, with a third and a fourth apertures 40, disposed in correspondence to said first and second apertures 2, as to coincide with each other when the container S is in closed condition, that is, folded over about said axis 140.

The fabric 3 is preferably left loose, that is, not stretched, in correspondence of said aperture 2. The fabric 3 can be made with an elastic material. In practice, the cloth 3 is loosely applied on the back of the first element 1, or is sufficiently elastic as to partially coming out through the shaped aperture 2 when pushed from the back.

Referring to the shown example, each of said third and fourth apertures 40 of the second element 4 is shaped likewise the corresponding aperture 2 of the first element 1. In practice, the first aperture 2 of the first element 1 is equal to the third aperture 40 provided by the second element 4, while the second aperture 2 of the first element 1 is equal to the fourth aperture 40 provided by the second element 4.

Said fist, second, third and fourth apertures 2, 40 can have all the same shape. In this way the container S has a containing volume defined by two equal semi-volumes.

Said first and second elements 1 and 4 can consist of one body, being joined in correspondence of a fold 14 of said body being defined by same elements. In other words, the body forming the two elements can be folded and internally glued. The glue can determinate the association of the cloth 3 disposed between the two elements, i.e. comprised in the inner of the folded body which forms the two elements 1 and 4.

Alternatively, the two elements 1 and 4 may also be separated at first, to be associated by gluing when forming the container S.

The glue utilized for associating the two elements 1 and 4 con be employed for fixing the fabric 3 to said two elements.

In the example a container S is shown to be used, for example, for containing small objects such as candies, chocolates, or small gifts 7 which, upon closing the package thus made, push the cloth 3 from the inside by causing an irregular, that is, casual swelling thereof. The container as described above can contain also other for small sized objects such as cosmetics or fragrances in grain or in leaves, etc.

Figure 5:
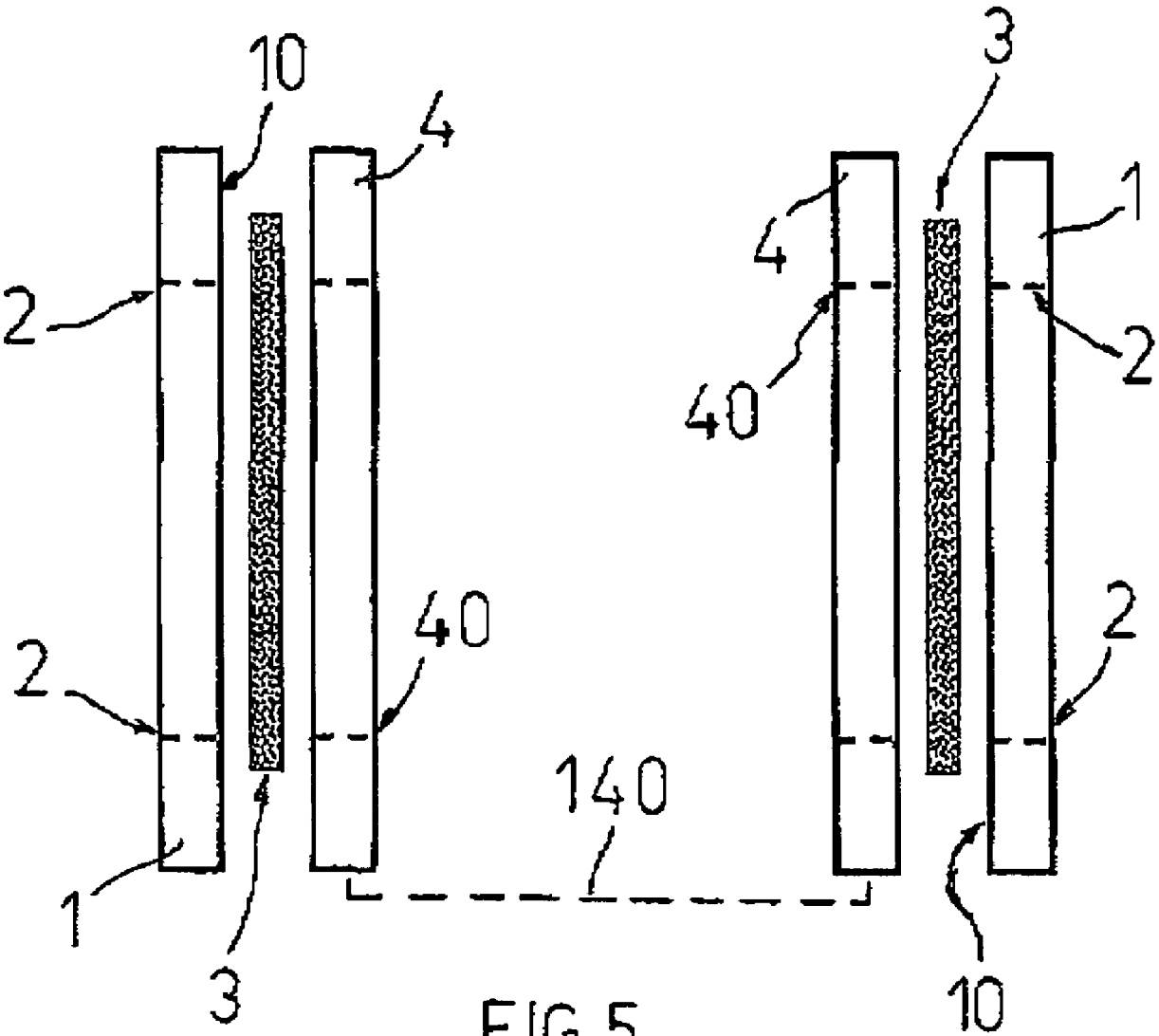
FIG. 5 is a schematic exploded side view of a possible embodiment of the invention.

More envelopes of this kind can be easily put on display-stands 8 provided with relevant slits 80 which define receiving seats. A possible example of embodiment of the container illustrated in FIGS. 1–4 may be provided with a single front element 1 having two apertures 2, and a single rear element 4 provided with two corresponding apertures 40 having the same shape as the apertures 2. In particular, the apertures reproduce two human profiles. Provided between the two elements 1 and 4 is the cloth 3 which, as previously stated, defines, in closed condition, a kind of small bag for holding candies 7. Numeral 140 designates a central folding line or axis which subdivides the structure of the container S into two equal parts. In FIG. 5, the folding axis 140 is schematically represented by a dashed line which links the two elements 4.

Said first and second elements 1, 4 of the present structure need not to be equal to each other, as their shape and dimensions can be different from each other.

In a possible embodiment, the apertures 2 and 40 of the container S can be shaped as human profiles or can reproduce well known silhouettes or outlines of works of art. These features give a highly aesthetic effect. The container, for its very pleasant aspect, can be utilized as a greeting card.

The construction details may vary in any equivalent way as far as the shape, dimensions, elements disposition, nature of the used materials are concerned, without nevertheless departing from the scope of the adopted solution idea and, thereby, remaining within the limits of the protection granted to the present patent.

What is claimed is:

1. A container for small sized objects, the container comprising:

a first element having a first and a second aperture symmetrically disposed with respect to a hinge axis and whose outline defines a geometric or fancy figure;

a flap or patch of fabric or cloth applied on a rear surface of said first element;

a second element associated with the rear surface of said first element on a back of said fabric so that said fabric is interposed between the first and second elements, said fabric being able to partly project from the surface defined by said first element or said second element, the surface of said second element having a third aperture and a fourth aperture, disposed in correspondence to said first and second apertures, as to coincide with each other when the container is in closed condition, folded over about said axis.

2. The container of claim 1, wherein said fabric is left loose, not stretched, in correspondence of said aperture.

3. The container of claim 1, wherein said fabric is elastic.

4. The container of claim 1, wherein each of said third and fourth apertures of the second element is shaped likewise the corresponding aperture of the first element.

5. The container of claim 1, wherein said first, second, third and fourth apertures have the same shape.

6. The container of claim 1, wherein said first and second elements consists of one body, as they are joined in correspondence of a fold of said body being defined by said first and second elements.

7. The container of claim 1, wherein said first, second, third and fourth apertures reproduce human profiles.

8. The container of claim 1, wherein said first, second, third and fourth apertures reproduce silhouettes or outlines of works of art.

* * * * *